US007583196B2

(12) United States Patent
Cohignac et al.

(10) Patent No.: US 7,583,196 B2
(45) Date of Patent: Sep. 1, 2009

(54) METHOD AND SYSTEM FOR DETECTING A BODY IN A ZONE LOCATED PROXIMATE AN INTERFACE

(75) Inventors: Thierry Cohignac, Paris (FR); Frederic Guichard, Paris (FR); Christophe Migliorini, Puteaux (FR); Fanny Rousson, Paris (FR)

(73) Assignee: Vision IQ, Boulogne Billancourt (FR)

( * ) Notice: Subject to any disclaimer, the term of this patent is extended or adjusted under 35 U.S.C. 154(b) by 289 days.

(21) Appl. No.: 10/566,250

(22) PCT Filed: Jul. 28, 2004

(86) PCT No.: PCT/FR2004/050363

§ 371 (c)(1),
(2), (4) Date: Oct. 10, 2006

(87) PCT Pub. No.: WO2005/013226

PCT Pub. Date: Feb. 10, 2005

(65) Prior Publication Data

US 2007/0052697 A1 Mar. 8, 2007

(30) Foreign Application Priority Data

Jul. 28, 2003 (FR) ..... 03 50378

(51) Int. Cl.
*G08B 23/00* (2006.01)

(52) U.S. Cl. ..... 340/573.1; 345/418; 438/488; 134/1.3

(58) Field of Classification Search ..... 340/573.1, 340/573.6; 430/348, 944, 952, 346; 250/330, 250/316.1, 338.1, 472.1; 348/164, 174, 176; 345/418

See application file for complete search history.

(56) References Cited

U.S. PATENT DOCUMENTS 4,779,095 A * 10/1988 Guerreri ..... 340/904
4,862,257 A * 8/1989 Ulich ..... 348/31
5,043,705 A * 8/1991 Rooz et al. ..... 340/573.1
5,638,048 A * 6/1997 Curry ..... 340/552

(Continued)

FOREIGN PATENT DOCUMENTS

WO 02/46796 6/2002
WO 02/097758 12/2002

*Primary Examiner*—Benjamin C Lee
*Assistant Examiner*—Eric M Blount
(74) *Attorney, Agent, or Firm*—Oblon, Spivak, McClelland, Maier & Neustadt, P.C.

(57) ABSTRACT

The invention concerns a method and a system for detecting a body (801) in a zone (802) located proximate an interface (803). The body is illuminated by an electromagnetic radiation (804) comprising at least two different wavelengths, located in ranges corresponding to near infrared and to green-blue. The method comprises the following steps: selecting two wavelengths; providing, for each of said wavelengths, an image (805) of the interface and of the zone; extracting from said data of each image two sets of data (807) respectively representing at least one part of the body in the near infrared range and in the green-blue range; comparing said data sets (807). It is thus possible to detect the presence of a body by discriminating between a body entirely located beneath the interface and a body located at least partly above the interface.

20 Claims, 7 Drawing Sheets

Figure 2A:
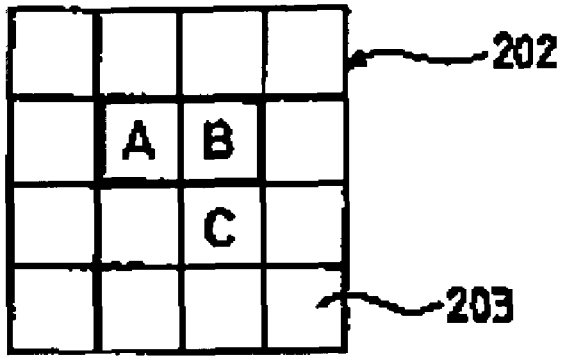

U.S. PATENT DOCUMENTS 5,880,771 A * 3/1999 Sutton ..... 348/31
5,959,534 A * 9/1999 Campbell et al. ..... 340/573.6
6,133,838 A * 10/2000 Meniere ..... 340/573.6
6,327,220 B1 * 12/2001 Miller et al. ..... 367/134
6,628,835 B1 * 9/2003 Brill et al. ..... 382/226
6,642,847 B1 * 11/2003 Sison ..... 340/565
6,963,354 B1 * 11/2005 Scheps ..... 348/31
7,123,746 B2 * 10/2006 Meniere et al. ..... 382/103

* cited by examiner

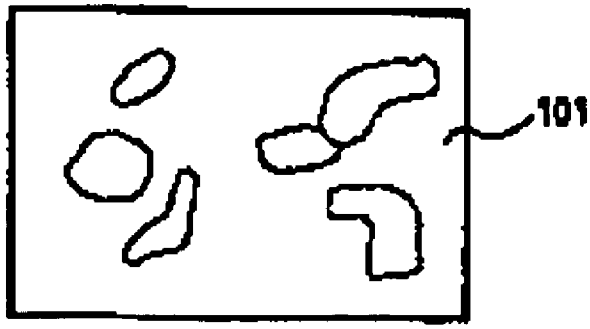
FIG_1a
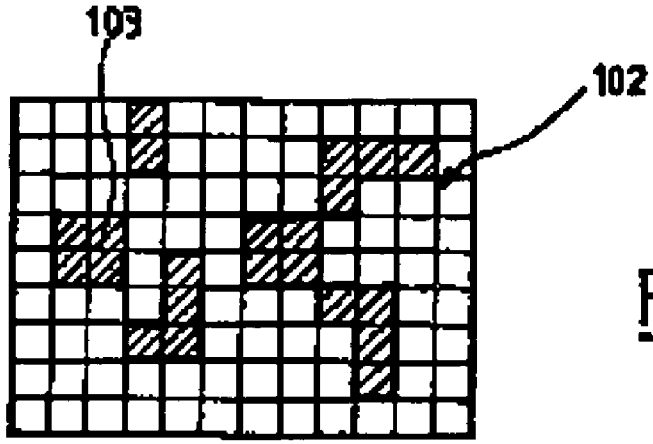
FIG_1b
| | | | | | |
|---|---|---|---|---|---|
| 1 | 1 | 1 | 1 | 1 | 1 |
| 1 | 2 | 1 | 1 | 3 | 1 |
| 1 | 2 | 3 | 2 | 1 | 1 |
| 1 | 1 | 4 | 1 | 1 | 1 |
| 1 | 8 | 3 | 2 | 1 | 7 |
103 102
FIG_1c

METHOD AND SYSTEM FOR DETECTING A BODY IN A ZONE LOCATED PROXIMATE AN INTERFACE

FIELD IN QUESTION

The present invention relates to a method, to a system and to devices for detecting an object in a zone situated in the proximity of an interface between two liquid and/or gaseous media, especially an interface of the water/air type. Within the meaning of the present invention, "in the proximity" also denotes "at the interface".

PROBLEM POSED

The problem relates to the detection of the presence of an object in the vicinity of an interface of water/air type. Besides this main problem, other problems include discrimination between the objects situated on one side or the other of the interface and detection of stationary objects.

The invention is dedicated more particularly to solving these different problems in the case, among others, of the four following applications:

- alarm if a stationary object is situated under the interface. For example, alarm in the case of a body immersed in the water for a time that is deemed to be too long;
- statistical estimation of the time of occupancy of a surveilled zone. This application makes it possible to perform statistical analyses on, in particular, the occupancy of a swimming pool;
- estimation of the trajectory of the objects;
- detection of the disappearance of an object from the surveilled zone. This application can be exploited in particular in the case of surveillance of swimmers at the seashore.

PRIOR ART

Different methods exist for detecting the presence of objects in a certain zone. In general they use a plurality of video sensors installed under the level of the interface. Although efficient, these techniques are not always convenient to use. They may also cause maintenance problems, especially in swimming pools that lack galleries for engineering facilities.

Moreover, to solve these problems, the applicant filed, on 6 Dec. 2000, French Patent No. 00/15803, entitled "Method, system and device for detecting an object in the proximity of a water/air interface". The device described in that patent uses, for detecting and locating objects relative to the interface, principles that are different from those constituting the object of the present application.

SOLUTION

The present invention solves the problem of detecting objects situated in the vicinity of an interface of water/air type by proposing a method and a system making it possible to evaluate the position of an object relative to an interface, especially of water/air type, to discriminate moving objects from stationary objects, to generate warnings, to process statistics, to furnish elements for plotting trajectories and to permit detection of when objects enter and leave the surveilled zone.

METHOD

The invention relates to a method for detecting an object in a zone situated in the proximity of an interface between two liquid and/or gaseous media, especially an interface of the water/air type. The object is illuminated by electromagnetic radiation comprising at least two different wavelengths, especially situated in regions corresponding to the near infrared on the one hand and to blue-green on the other hand.

The media have different absorption coefficients as a function of the wavelengths of the electromagnetic radiation. The method comprises the following stages:

(a) the stage of choosing, from among the wavelengths of the electromagnetic radiation, at least two wavelengths or two wavelength regions, (b) the stage of creating, for each of the wavelengths or wavelength regions, an image of the interface and of the zone, (c) the stage of producing electrical signals representative of each image, (d) the stage of digitizing the electrical signals in such a way as to produce data corresponding to each image, (e) the stage of extracting, from the data corresponding to each image, two groups of data, wherein the groups are representative of at least part of the object in the near infrared region and in the blue-green region respectively, (f) the stage of comparing the groups of data.

Stages (c) to (f) are referred to hereinafter as the process of deducing the presence of an object. It results from the combination of technical features that it is possible thereby to detect the presence of an object and/or to determine the position of the detected object relative to the interface, while discriminating between an object situated entirely under the interface and an object situated at least partly above the interface.

Preferably, according to the invention, the method additionally comprises the stage of integrating over time the results of the stage of comparison of the groups of data.

Preferably, according to the invention, the method additionally comprises the stage of tripping an alarm if an object of human size is detected under the interface for a time longer than a specified threshold.

Preferably, according to the invention, the method is such that calottes (within the meaning of the present invention) are generated in order to extract, from the data corresponding to each image, two groups of data, wherein the groups are representative of at least part of the object in the near infrared region and in the blue-green region respectively.

Preferably, according to the invention, the method additionally comprises the following stages:

the stage of associating characteristics with each calotte, the stage of deducing the presence of a group of data, wherein the group is representative of at least part of the object, if the characteristics exceed a predetermined threshold SC.

Preferably, according to the invention, the method is such that, in order to compare the groups of data, a search is performed for data representative of at least part of the object in the blue-green region, for which data, within a specified geometric vicinity, there are no corresponding data representative of at least part of the object in the near infrared region.

In this way, it can be concluded from a positive search that the object is situated under the interface.

Preferably, according to the invention, the method is such that, in order to compare the groups of data, a search is performed for data representative of at least part of the object in the blue-green region, for which data, within a specified geometric vicinity, there are corresponding data representative of at least part of the object in the infrared region.

In this way, it can be concluded from a positive search that the object is situated at least partly above the interface.

According to one alternative embodiment of the invention, the method is more particularly intended to discriminate between a stationary object and a moving object. Preferably, in the case of this alternative embodiment, in order to integrate over time the results of the comparison of the groups of data, the method additionally comprises the following stages:

the stage of iterating, at specified time intervals, the process of deducing the presence of the object, the stage of calculating the number of times that the object is detected during a specified time period T1, the stage of discriminating, at one point of the zone, between the objects that are present a number of times greater than a specified threshold S1 (these objects are referred to hereinafter as stationary objects) and the objects that are present a number of times smaller than the specified threshold S1 (these objects are referred to hereinafter as moving objects).

In this way it is possible to detect the presence of a stationary object situated entirely under the interface and consequently to trip an alarm.

SYSTEM

The invention also relates to a system for detecting an object in a zone situated in the proximity of an interface between two liquid and/or gaseous media, especially of the water/air type. The object is illuminated by electromagnetic radiation comprising at least two different wavelengths, especially situated in regions corresponding to the near infrared on the one hand and to blue-green on the other hand. The media have different absorption coefficients as a function of the wavelengths of the electromagnetic radiation. The system comprises:

(a) selecting means for choosing, from among the wavelengths of the electromagnetic radiation, at least two wavelengths or two wavelength regions, (b) filming means for creating, for each of the wavelengths or wavelength regions, an image of the interface and of the zone, (c) converting means for producing electrical signals representative of each image, (d) digitizing means for digitizing the electrical signals in such a way as to produce data corresponding to each image, (e) information-processing means for extracting, from the data corresponding to each image, two groups of data, wherein the groups are representative of at least part of the object in the near infrared region and in the blue-green region respectively, (f) calculating means for comparing the groups of data.

The converting means, the digitizing means, the information-processing means and the calculating means are referred to hereinafter as the means for deducing the presence of an object. It results from the combination of technical features that it is possible thereby to detect the presence of an object and/or to determine the position of the detected object relative to the interface, while discriminating between an object situated entirely under the interface and an object situated at least partly above the interface.

Preferably, according to the invention, the system additionally comprises means for integrating over time the results of the means for calculating groups of data.

Preferably, according to the invention, the system additionally comprises activating means for activating an alarm if an object of human size is detected under the interface for a time longer than a specified threshold.

Preferably, according to the invention, the system is such that the information-processing means make it possible to generate calottes (within the meaning of the present invention).

Preferably, according to the invention, the system is such that the information-processing means make it possible:

to associate characteristics with each calotte, to deduce the presence of a group of data, wherein the group is representative of at least part of the object, if the characteristics exceed a predetermined threshold SC.

Preferably, according to the invention, the system is such that the calculating means make it possible to search for data representative of at least part of the object in the blue-green region for which data, within a specified geometric vicinity, there are no corresponding data representative of at least part of the object in the near infrared region.

It results from the combination of technical features that it can be concluded from a positive search that the object is situated under the interface.

Preferably, according to the invention, the system is such that the calculating means make it possible to search for data representative of at least part of the object in the blue-green region, for which data, within a specified geometric vicinity, there are corresponding data representative of at least part of the object in the near infrared region.

It results from the combination of technical features that it can be concluded from a positive search that the object is situated at least partly above the interface. In the case of one alternative embodiment of the invention, the system is more particularly intended to discriminate between a stationary object and a moving object. Preferably, in the case of this alternative embodiment, the system is such that the integrating means for integrating over time the results of the calculating means make it possible:

to iterate, at specified time intervals, the use of the means for deducing the presence of the said object, to calculate the number of times that the object is detected during a specified time period T1, to discriminate, at one point of the said zone, between the objects that are present a number of times greater than a specified threshold S1 (these objects are referred to hereinafter as stationary objects) and the objects that are present a number of times smaller than the specified threshold S1 (these objects are referred to hereinafter as moving objects).

In this way it is possible to detect the presence of a stationary object situated entirely under the interface. Consequently it is possible in this way to trip an alarm.

DETAILED DESCRIPTION

Figure 2B:
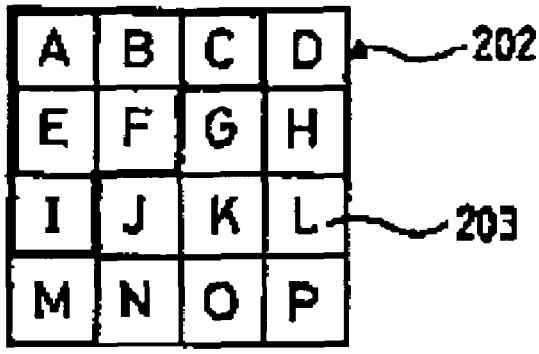
Figure 2C:
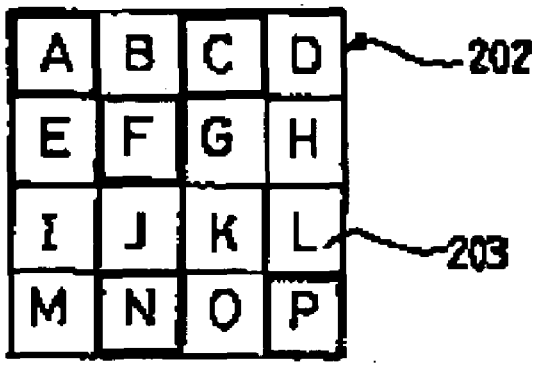
Figure 3B:
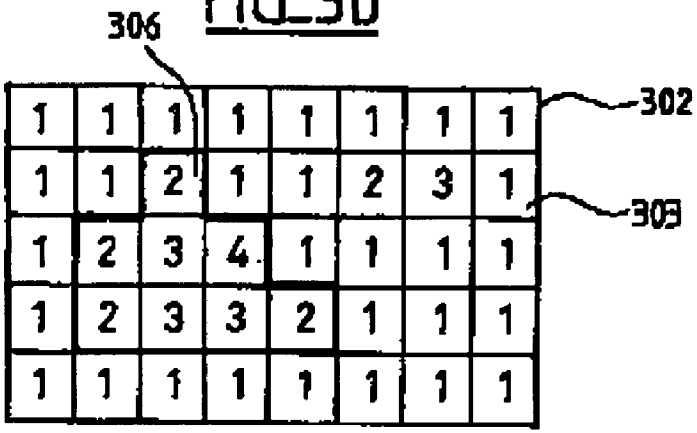
Figure 4B:
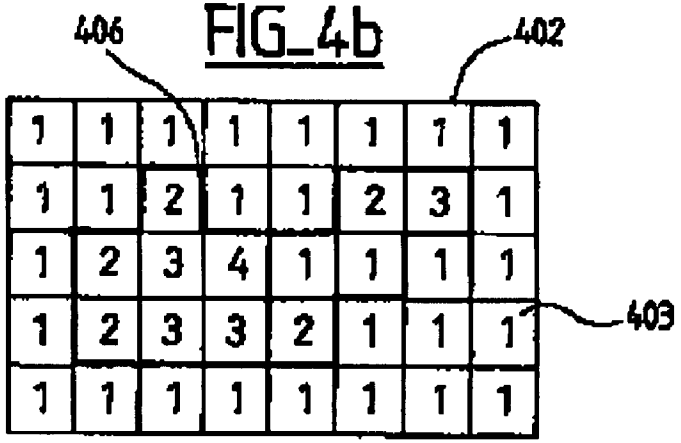
Figure 3A:
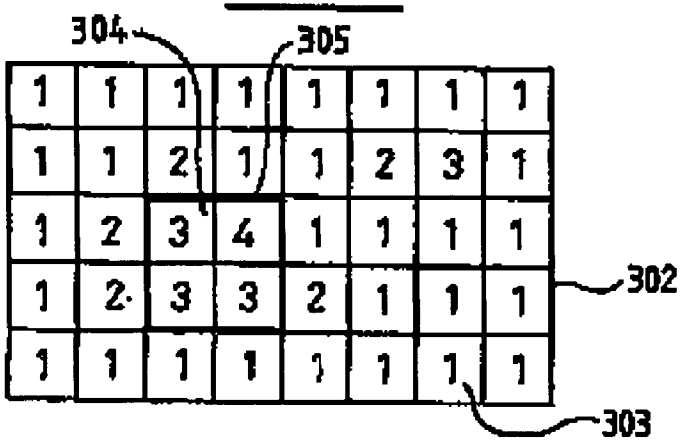
Figure 4A:
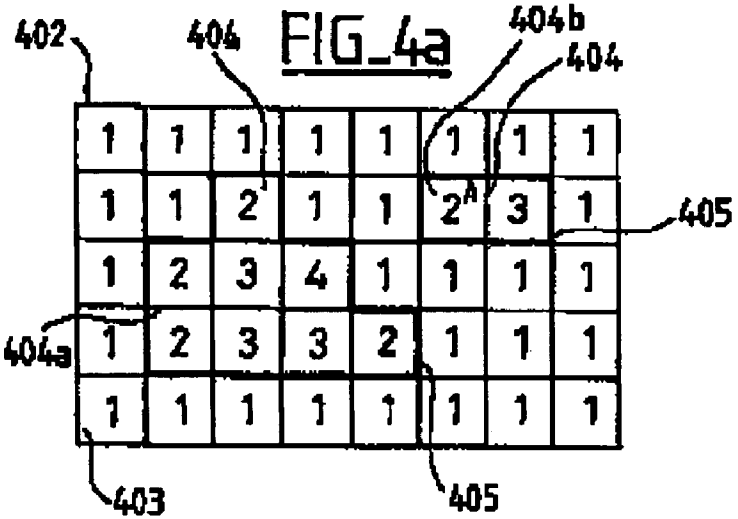
Figure 5:
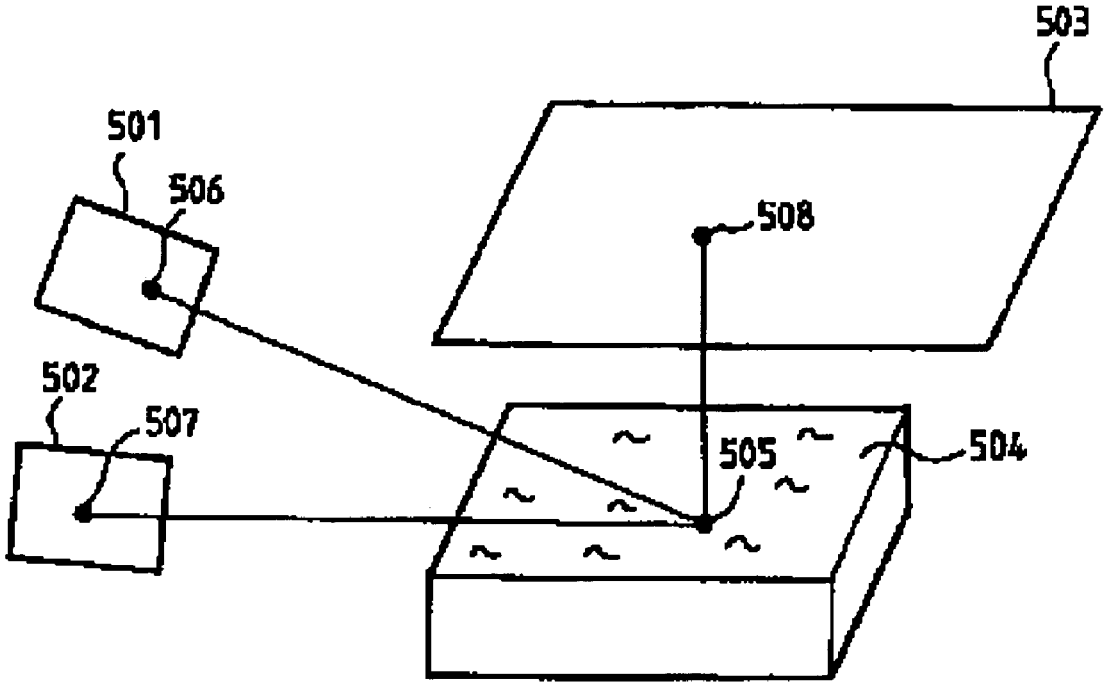
Figure 6:
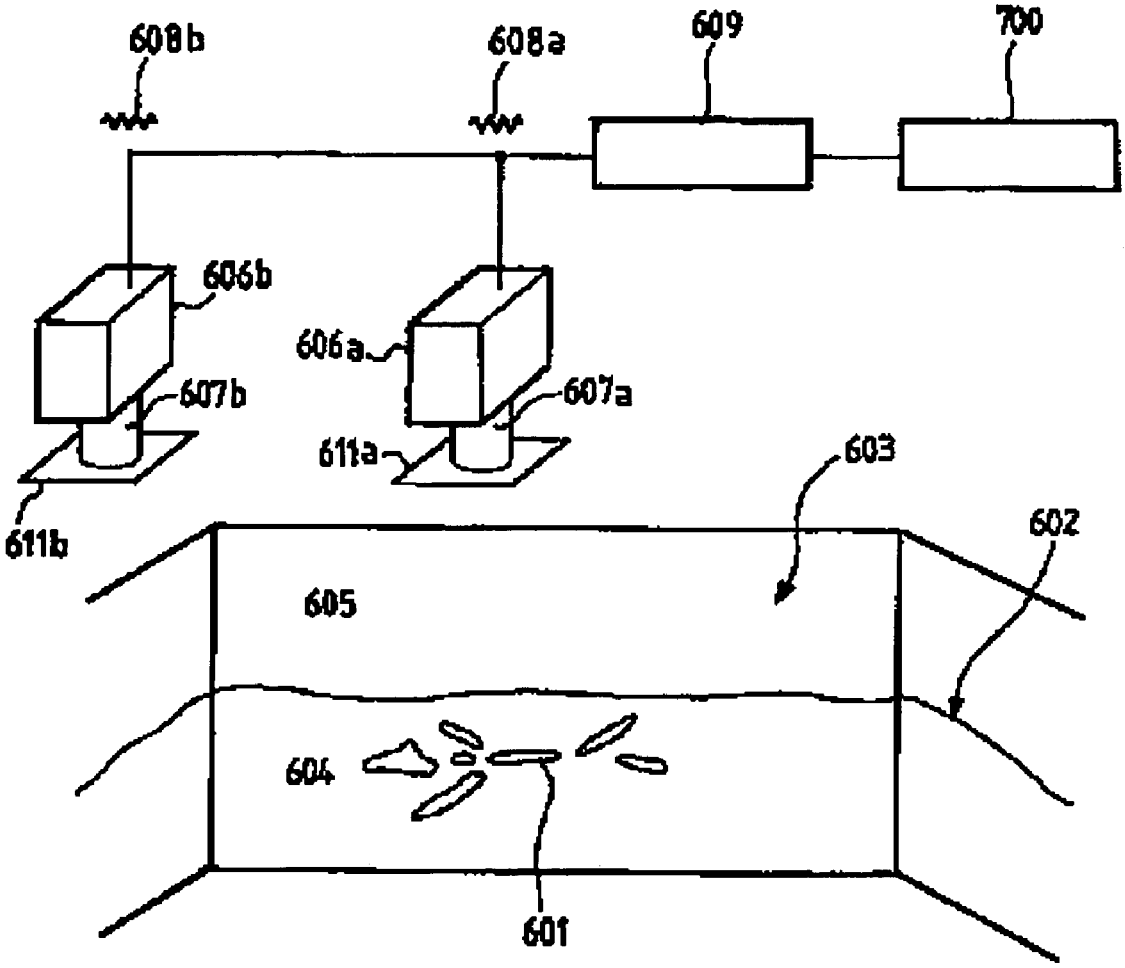
Figure 7:
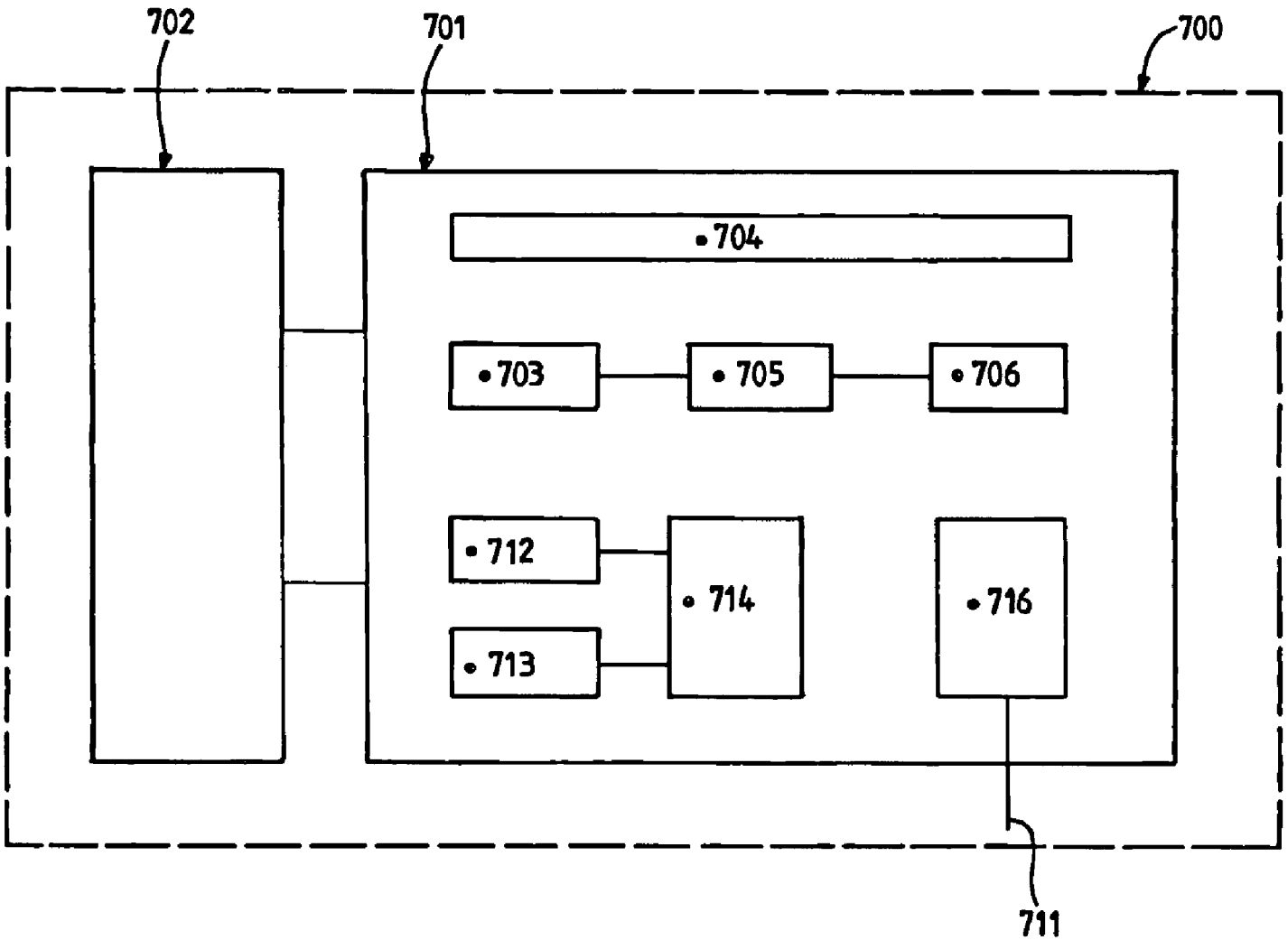
Figure 8:
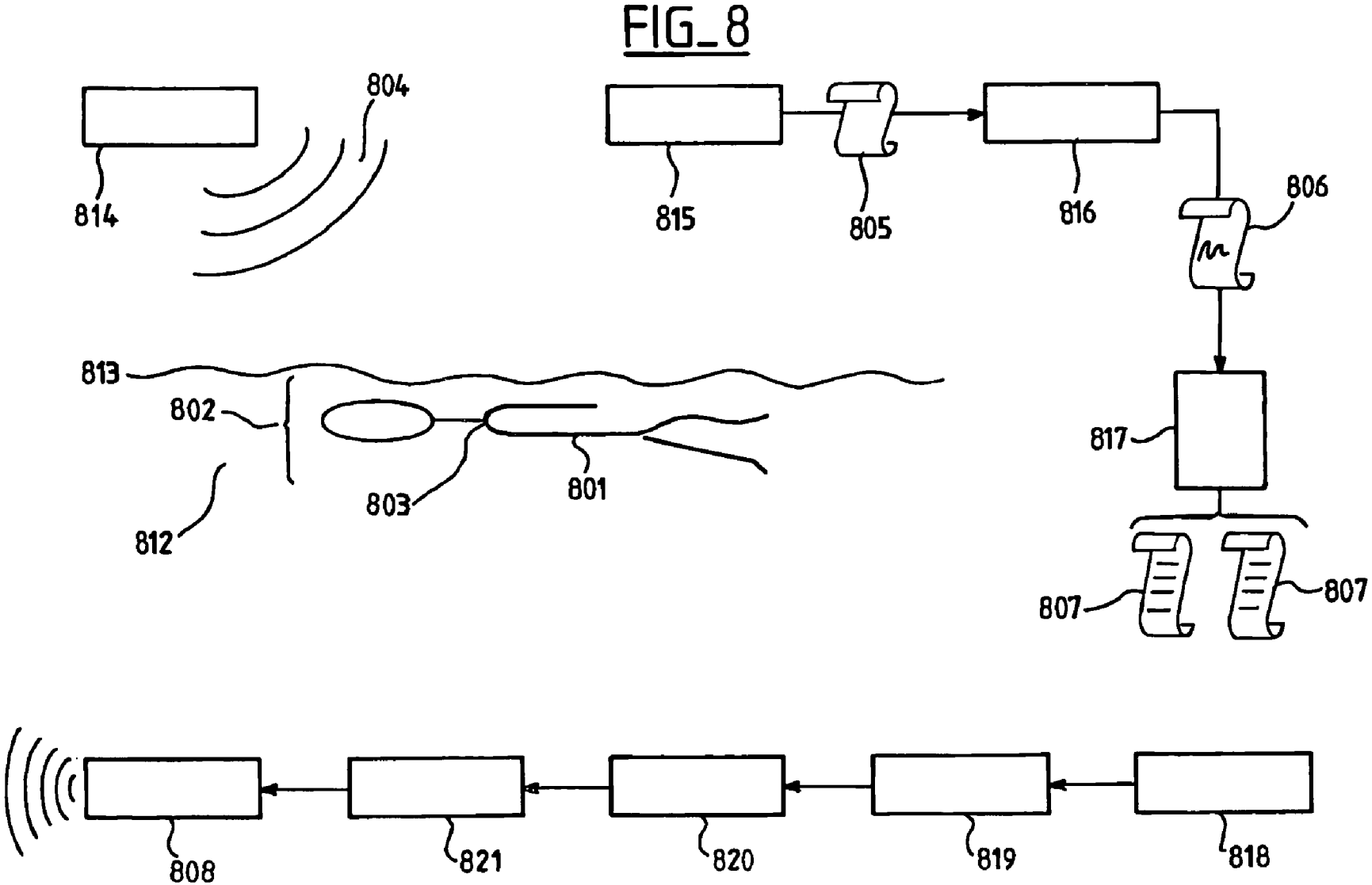

Other characteristics and advantages of the invention will become clear from reading the description of alternative embodiments of the invention, given by way of indicative and non-limitative example, and from the following figures:

FIGS. 1*a*, 1*b*, 1*c*, which respectively represent an image, an image superposed by a grid and an image composed of a grid of pixels, on which the values thereof have been indicated, in such a way as to illustrate the notion of a grid of pixels, FIGS. 2*a*, 2*b*, 2*c*, which represent an image composed of a grid of pixels, on which the values thereof have been indicated, in such a way as to illustrate the notion of a connected set of pixels, FIGS. 3*a*, 3*b*, 4*a*, 4*b*, which represent an image composed of a grid of pixels, on which the values thereof have been indicated, in such a way as to illustrate the notion of the level of a calotte, FIGS. 5 and 6, which represent, in the case of a swimming pool, a general view of the system that permits the detection of objects situated in the vicinity of an interface of water/air type, especially the detection and surveillance of swimmers, FIG. 7, which represents an organizational diagram of the information-processing means, FIG. 8 represents a schematic general view of the system according to the invention.

Before the system and the different parts of which it is composed are described with reference to FIGS. 5, 6, 7 and 8, certain technical terms will be explained with reference to FIGS. 1*a* to 4.

DEFINITIONS

The definitions hereinafter explain the technical terms employed in the present invention.

Pixel, Pixel Value

There is termed pixel: an elemental zone of an image obtained by creating a grid, generally regular, of the said image. When the image originates from a sensor such as a video camera or a thermal or acoustic camera, a value generally can be assigned to this pixel: the color or gray level for a video image.

EXAMPLE

FIG. 1*a* represents an image 101 (symbolized by a man swimming on the surface of a swimming pool, whose contours are not fully visible). In FIG. 1*b*, a grid 102 of pixels 103 is superposed on this image. FIG. 1*c* shows a grid on which the values of the pixels are indicated.

Adjacent Pixels

Two pixels of the grid are said to be adjacent if their edges or corners are touching.

Path on the Grid

A path on the grid is an ordered and finite set of pixels in which each pixel is adjacent to that following it (in the direction of ordering). The size of a path is given by the number of pixels of which it is composed.

Joined Pixels

Two pixels are said to be joined when the shortest path beginning at one and ending at the other is of size smaller than a specified number of pixels.

Connected Set of Pixels

A set of pixels is said to be connected if, for each pair of pixels of the set, there exists a path beginning at one and ending at the other, this path being composed of pixels of the set.

EXAMPLE

FIG. 2*a* represents a grid 202 of 16 pixels 203, among which 3 pixels are specifically identified as A, B and C. It can be noted that pixels A and B are adjacent, and that pixels B and C are adjacent. Thus there exists a path (A->B->C) that links these pixels. The set of pixels {A, B, C} is therefore connected.

FIG. 2*b* also shows a grid 202 of 16 pixels 203, identified by the letters A to P. If the set of pixels {A, B, C, E, F, I} is selected, it can be noted that pixels A and B are adjacent, that pixels B and C are adjacent, and so on. Thus there exist the following paths: A->B->C and C->B->F->E->I. Each pair of pixels of the set is linked by a path of pixels belonging to the set, and so the set of pixels {A, B, C, E, F, I} is connected.

FIG. 2*c* shows the same grid 202 as in FIG. 2*b*, with the set of pixels {A, C, F, N, P} selected. There exists a path A->C->F linking the pixels A, C and F, but there does not exist a path of pixels that belongs to the set and that links N and P or else N to A. The set of pixels {A, C, F, N, P} is not connected. In contrast, the set {A, C, F} is connected.

Pixel Adjacent to a Set

A pixel that does not belong to a set is said to be adjacent to the said set when it is joined to at least one pixel belonging to the said set.

Calotte

There is termed positive (or negative) calotte: a connected set of pixels whose values are larger (or smaller) than a predetermined value and satisfy the following condition:

the values of the pixels adjacent to the set (not members of the set) are smaller than or equal to (or larger than or equal to) the said predetermined value, such that the values of the pixels located in the said set are larger (or smaller) than the values of the pixels adjacent to the set.

Level of a Calotte

There is termed level of a positive or negative calotte the said predetermined value.

EXAMPLE

FIGS. 3*a*, 3*b*, 4*a* and 4*b* represent images composed of grids 302 (or 402) of pixels 303 (or 403), on which the values thereof are indicated.

FIG. 3*a* represents (in the interior 304 of the bold line 305) a set of 4 pixels. This set has the following properties:

- it is connected within the meaning of the given definition,
- the values of all of the pixels of the set are larger than 1,
- some of the (twelve) pixels adjacent to the set have values larger than 1.

Thus the set of pixels in question is not a positive calotte of level 1.

In contrast, this set of pixels has the following properties:

- it is connected within the meaning of the given definition,
- the values of all of the pixels of the set are larger than 2,
- all of the (twelve) pixels joined to the set have a value smaller than or equal to 2.

This set of pixels is therefore a positive calotte of level 2.

FIG. 3*b* represents a set 306 of eight pixels having the following properties:

- it is connected within the meaning of the given definition,
- the values of all of the pixels of the set are larger than 1,
- all of the (eighteen) pixels joined to the set have a value smaller than or equal to 1.

Thus the set of pixels in question is a positive calotte of level 1.

FIG. 4*a* represents a grid 402 of pixels 403. Inside this grid 402 a bold line 405 isolates a set 404 of ten pixels distributed into two zones 404*a* and 404*b*. This set 404 of pixels has the following properties:

- it is not connected within the meaning of the given definition,
- the values of all of the pixels are larger than 1,
- all of the (twenty-five) pixels joined to the set have a value smaller than or equal to 1.

Thus the ten pixels of this non-connected set do not comprise a positive calotte of level 1.

FIG. 4*b* represents a set 406 of twelve pixels having the following properties:

- it is connected within the meaning of the given definition, the values of the pixels are not all larger than 1, all of the (twenty-four) pixels joined to the set have a value smaller than or equal to 1.

Thus the set of pixels in question is not a positive calotte of level 1.

Characteristic(s) Associated with a Calotte

There are termed characteristic or characteristics associated with a calotte: a value or values obtained by predefined arithmetic and/or logical operations from the values of the pixels of the calotte, and/or from the positions of the pixels in the grid, and/or from the level of the calotte.

For example, an arithmetic operation could comprise using the sum of the differences between the value of each pixel of the calotte and the level of the calotte, or else the size (number of pixels) of the said calotte.

Materialized Calotte

There is termed materialized positive calotte (or materialized negative calotte): a positive (or negative) calotte whose associated characteristics are in a specified value range.

Geometric Vicinity

The system and the different parts of which it is composed will now be described with reference to FIGS. 5, 6 and 7.

FIG. 5 represents a schematic view of the system permitting detection of objects situated in the vicinity of an interface of water/air type.

Since blue-green images 501 and near infrared images 502 are not necessarily filmed from the same observation point, it will be advantageously possible to map the data or the images into a virtual common reference space 503. It will be possible for the virtual reference space to correspond to the water surface 504, in such a way that a point 505 of the water surface, viewed by blue-green camera 506 and viewed by near infrared camera 507, will be at the same place 508 in the virtual common reference space. In this way, close points in this virtual common reference space will correspond to two close points in real space. The notion of geometric reference space will correspond to the notion of proximity in the virtual common reference space.

FIG. 6 represents, in the case of a swimming pool, a general view of the system that permits the detection of objects situated in the vicinity of an interface of water/air type, especially the detection and surveillance of swimmers.

The system according to the invention comprises means, to be described hereinafter, for detecting an object 601 in a zone 603 situated in the proximity of an interface 602 between two liquid media 604 and/or gaseous media 605, especially of water/air type; the said object being illuminated by electromagnetic radiation comprising at least two different wavelengths, especially situated in regions corresponding to the near infrared on the one hand and to blue-green on the other hand; the said media having different absorption coefficients as a function of the wavelengths of the electromagnetic radiation.

Within the meaning of the present invention, "in the proximity" also denotes "at the interface".

The system also comprises the following means:

A video camera 606*a*, equipped with a filter that permits the creation of at least one video image in the wavelength region from 300 to 700 nm (hereinafter referred to as the blue-green region).

A video camera 606*b*, equipped with a filter that permits the creation of at least one video image in the wavelength region from 780 to 1100 nm (hereinafter referred to as the near infrared region).

These cameras make it possible to create video images of the said interface 602 and of the said zone 603 from at least two observation points 607*a* and 607*b*.

These images are represented by electrical signals 608*a* and 608*b*.

Each of the observation points 607*a* and 607*b* is situated on one side of the said interface 602. In the present case, observation points 607*a* and 607*b* are situated above the swimming pool. Video cameras 606*a* and 606*b* and their cases are overhead, open-air devices.

The said system additionally comprises digital conversion means 609 for producing digital data from the electrical signals 608*a* and 608*b* representative of the blue-green and near infrared video images.

Advantageously, when the said object 601 is illuminated by light that produces reflections at the said interface, cameras 606*a* and 606*b* are equipped with polarizing filters 611*a* and 611*b* to eliminate, at least partly, the light reflections at the said interface in the said images. This alternative embodiment is particularly appropriate in the case of a swimming pool reflecting the rays of the sun or those of artificial illumination.

The said system additionally comprises information-processing means 700, described hereinafter.

FIG. 7 represents an organizational diagram of information-processing means 700.

Information-processing means 700 make it possible to discriminate the data corresponding to the blue-green video images of part of a real object (FIG. 1*a*) from those that correspond to the apparent blue-green video images (FIG. 1*b*) generated by the said interface 602.

Information-processing means 700 also make it possible to discriminate the data corresponding to the near infrared video images of part of a real object (FIG. 1*a*) from those that correspond to the apparent near infrared video images (FIG. 1*b*) generated by the said interface 602.

The said information-processing means 700 comprise calculating means, especially a processor 701 and a memory 702.

Information-processing means 700 comprise extracting means 712 making it possible to extract a group of data representative of at least part of the object in the near infrared region. Information-processing means 700 also comprise extracting means 713 making it possible to extract a group of data representative of at least part of the object in the blue-green region.

In one alternative embodiment, in order to extract groups of data, wherein the groups are representative of at least part of the object in the near infrared region and in the blue-green region, extracting means 712 and 713 generate calottes, associate characteristics with each calotte, deduce the presence of a group of data, wherein the group is representative of at least part of the object, if the characteristics exceed a predetermined threshold SC.

One example of a characteristic associated with a calotte can be its area, defined by the number of pixels of which it is composed. Another characteristic associated with a calotte can be its contrast, defined as being the sum of the differences between the value of each pixel of the calotte and the level of the calotte.

One example of a group of data, wherein the group is representative of part of an object, can then be a calotte having a contrast greater than a threshold SC and an area ranging between a threshold TailleMin [minimum size] and a threshold TailleMax [maximum size] representative of the minimum and maximum dimensions of the surveilled parts of the object.

In an alternative embodiment relating to swimming pools, information-processing means 700 make it possible to select, from among the extracted groups of data, those that do not correspond to part of a swimmer. Advantageously, the system comprises means making it possible to eliminate the calottes that correspond to reflections, to lane ropes, to mats and to any object potentially present in a swimming pool and not corresponding to part of a swimmer. Examples of selection can be achieved by calculating the level of the calottes, which must be smaller than a threshold SR corresponding to the mean gray level of the reflections, by calculating the alignment of the calottes that correspond to the usual position of lane ropes, and by estimating the shape of the calottes, which should not be rectangular if the mats are to be eliminated.

To extract groups of data representative of at least part of the object in the near infrared region and in the blue-green region, extracting means 712 and 713 will be able to proceed in a manner other than by extraction of calottes. For example, extracting means 712 and 713 will be able to extract groups of pixels that share one or more predetermined properties, and then to associate characteristics with each group of pixels and to deduce the presence of a group of data, wherein the group is representative of at least part of the object, if the characteristics exceed a predetermined threshold SC. It will be possible, for example, to choose the predetermined property or properties in such a way that the appearance of the water/air interface is excluded from the image. For example, in the case of infrared images, it will be possible to extract the groups of pixels whose luminosity is clearly greater than the mean luminosity of the image of the interface and whose size is comparable with that of a human body.

The said information-processing means 700 additionally comprise comparing means 714 for comparing the said groups of data. In one alternative embodiment, the said comparing means 714 search for data representative of at least part of the said object in the blue-green region, for which data, within a geometric comparison vicinity, there are no corresponding data representative of at least part of the said object in the near infrared region. In this way, if the search is positive, it can be concluded that the said object is situated under the interface.

In the particular case of locating a swimmer relative to the water surface, a search is made, in a geometric comparison vicinity such as a circular vicinity with a radius of 50 cm, centered on the center of gravity of the calottes extracted from the blue-green image, for calottes extracted from the near infrared image. If the search is negative, the swimmer is considered to be under the water surface.

To compare the said groups of data, a search is made for data representative of at least part of the said object in the blue-green region, for which data, in a geometric comparison vicinity, there are corresponding data representative of at least part of the said object in the near infrared region. In this way, if the search is positive, it can be concluded that the said object is situated at least partly above the interface.

In the particular case of locating a swimmer relative to the water surface, a search is made, in a geometric comparison vicinity such as a circular vicinity with a radius of 50 cm, centered on the center of gravity of the calottes extracted from the blue-green image, for calottes extracted from the near infrared image. If the search is positive, the swimmer is considered to be at least partly above the water surface.

In one alternative embodiment, again for locating a swimmer relative to the water/air interface, the calottes extracted from the blue-green image and those extracted from the near infrared image are paired if the shortest distance (between the two pixels that are closest) is less than 30 cm. The non-paired calottes of the blue-green image will then be considered as being a swimmer under the water surface. The paired calottes of the blue-green image will be considered as swimmers partly above the water surface.

The geometric comparison vicinity is not necessarily specified. In one alternative embodiment, the geometric comparison vicinity can be defined, in relation to the infrared and blue-green calottes respectively, as a function of geometric considerations relating to the positions of the said calottes and possibly also as a function of geometric considerations specific to the environment, in particular the orientation of the cameras relative to the interface or the orientation of the normal to the interface within the images. Since the calottes obtained from the infrared cameras correspond to the parts of objects situated above the interface, the corresponding blue-green calottes will be searched for in a geometric comparison vicinity calculated as a function of the orientation of the normal to the interface.

In another alternative embodiment, the system described in the present invention can be used as a complement to a system based on stereoscopic vision, such as that described in French Patent No. 00/15803.

In the case in which the system described in French Patent No. 00/15803 detects an object under the water surface and

- if, within a specified geometric vicinity, there are corresponding data representative of at least part of the said object in the near infrared region, it can be concluded that the said object is situated at least partly above the interface,
- if, within a specified geometric vicinity, there are no corresponding data representative of at least part of the said object in the near infrared region, it can be concluded that the said object is situated under the interface.

In another alternative embodiment, the system described in the present invention can advantageously use principles of stereoscopic vision such as those described in French Patent No. 00/15803. In the particular case in which a plurality of blue-green cameras and/or a plurality of near infrared cameras are used, these will be able to operate in stereoscopic vision.

In the case in which the said system is intended more particularly to discriminate between a stationary object (a swimmer in difficulty) and a moving object (a swimmer frolicking in a pool), the said system comprises a time integrator 703, associated with a clock 704, for iterating, at specified time intervals, the said process, described hereinabove, of deducing the presence of an object. For this purpose, the video images are filmed from the said observation point at specified time intervals. In this case, the said information-processing means 700 comprise totalizers 705 for calculating the number of times that the object is detected during a specified time period T1. The said information-processing means 700 also comprise discriminators 706 for discriminating, at one point of the said zone, between the objects that are present a number of times larger than a specified threshold S1 and the objects that are present a number of times smaller than the said specified threshold S1. In the first case, the said objects are referred to hereinafter as stationary objects, in the second case the said objects are referred to hereinafter as moving objects.

In one alternative embodiment, the said information-processing means 700 additionally comprise means for calculating the number of times that an object is detected as being stationary and new during a specified time period T2. The said time period T2 is chosen to be longer than the duration of the phenomena being observed, and in particular longer than T1.

The said information-processing means 700 additionally comprise emitting means 716 for emitting a warning signal 711 according to the detection criteria described hereinabove, In particular, in an alternative embodiment more particularly appropriate for surveillance of swimmers in a swimming pool, the system emits a warning signal 711 in the presence of a stationary object of human size situated under the interface.

In one alternative embodiment of the said system, a supplementary stage of time integration advantageously can be implemented by accumulation of images originating from one given blue-green and/or near infrared camera. The cumulative image is calculated, for example, by averaging the gray levels of the pixels of successive images filmed over a specified time interval. A cumulative image obtained by accumulation of images originating from a blue-green camera will be referred to as a cumulative blue-green image. Similarly, a cumulative image obtained by accumulation of images originating from a near infrared camera will be referred to as a cumulative near infrared image. Extracting means 712 and 713 will then also be able to use the cumulative blue-green and/or near infrared images. For example, extracting means 712 will be able to extract only those calottes of the blue-green image for which, in the cumulative blue-green image, no similar calotte is situated in a vicinity. Extracting means 712 and 713 then also will be able to use composite images composed of cumulative blue-green images and blue-green images as well as composite images composed of cumulative near infrared images and near infrared images. For example, extracting means 712 will be able to use the difference between the blue-green image and the cumulative blue-green image.

FIG. 8, which represents a schematic general view of the system according to the invention, now will be described.

The system makes it possible to detect an object 801 in a zone 802 situated in the proximity of an interface 803 between two liquid media 812 and/or gaseous media 813, especially an interface of the water/air type. The object 801 is illuminated by electromagnetic radiation 804 comprising at least two different wavelengths, especially situated in regions corresponding to the near infrared on the one hand and to blue-green on the other hand. Media 812 and 813 have different absorption coefficients as a function of the wavelengths of the electromagnetic radiation. The system comprises:

(a) selecting means 814 for choosing, from among the wavelengths of electromagnetic radiation 804, at least two wavelengths or two wavelength regions, (b) filming means 815 for creating an image 805 of the interface and of the zone for each of the wavelengths or wavelength regions, (c) converting means 816 for producing electrical signals 6 representative of each image 805, (d) digitizing means 817 for digitizing electrical signals 806 in such a way as to produce data 807 corresponding to each image, (e) information-processing means 818 for extracting, from the data 807 corresponding to each image 805, two groups of data 807, wherein the groups are representative of at least part of object 801 in the near infrared region and in the blue-green region respectively, (f) calculating means 819 for comparing the groups of data 807.

Converting means 816, digitizing means 817, information-processing means 818 and calculating means 819 are referred to hereinafter as the means for deducing the presence of an object 801. It is possible thereby to detect the presence of an object 801 and/or to determine the position of the detected object relative to interface 803, while discriminating between an object 801 situated entirely under interface 803 and an object 801 situated at least partly above interface 803.

In the case of the alternative embodiment represented in FIG. 809, the system additionally comprises integrating means 820 for integrating over time the results of means 819 for calculating the groups of data 807.

In the case of the alternative embodiment represented in FIG. 809, the system additionally comprises activating means 821 for activating an alarm 808 if an object of human size is detected under the interface for a time longer than a specified threshold.

The invention claimed is:

1. A method for detecting an object in a zone situated in the proximity of an interface between two liquid and/or gaseous media; the said object being illuminated by electromagnetic radiation comprising at least two different wavelengths; the said media having different absorption coefficients as a function of the wavelengths of the electromagnetic radiation; the said method comprising:

choosing, from among the wavelengths of the electromagnetic radiation, at least two wavelengths or two wavelength regions, creating, for each of the said wavelengths or wavelength regions, an image of the said interface and of the said zone, producing electrical signals representative of each image, digitizing the electrical signals to produce data corresponding to each image, extracting, from the said data corresponding to each image, two groups of data, wherein the groups are representative of at least part of the said object in the near infrared region and in the blue-green region respectively, and comparing the said groups of data, the producing, the digitizing, the extracting, and the comparing being referred to hereinafter as the process of deducing the presence of an object, whereby detecting the presence of an object and/or determining the position of the detected object relative to the said interface, while discriminating between an object situated entirely under the interface and an object situated at least partly above the interface.

2. The method according to claim 1, additionally comprising:

integrating over time the results of the stage of comparison of the said groups of data.

3. The method according to claim 2 additionally comprising:

tripping an alarm if an object of human size is detected under the said interface for a time longer than a specified threshold.

4. The method according to claim 1, wherein calottes are generated in order to extract, from the said data corresponding to each image, two groups of data, and wherein the groups are representative of at least part of the said object in the near infrared region and in the blue-green region respectively.

5. The method according to claim 4, additionally comprising:

associating characteristics with each calotte, and deducing the presence of a group of data, wherein the group is representative of at least part of the said object if the characteristics exceed a predetermined threshold.

6. The method according to claim 1, wherein, in order to compare the said groups of data, a search is performed for data representative of at least part of the said object in the blue-green region, for which data, within a specified geometric vicinity, there are no corresponding data representative of at least part of the said object in the near infrared region, whereby concluding from a positive search that the said object is situated under the interface.

7. The method according to claim 1, wherein, in order to compare the said groups of data, a search is performed for data representative of at least part of the said object in the blue-green region, for which data, within a specified geometric vicinity, there are corresponding data representative of at least part of the said object in the near infrared region, whereby concluding from a positive search that the said object is situated at least partly above the interface.

8. The method according to claim 2, more particularly intended to discriminate between a stationary object and a moving object; to integrate over time the results of the stage of comparison of the said groups of data, the said method additionally comprising:

iterating, at specified time intervals, the said process of deducing the presence of the said object;

calculating the number of times that the said object is detected during a specified time period; and discriminating, at one point of the said zone, between the said objects that are present a number of times greater than a specified threshold (the said objects being referred to hereinafter as stationary objects) and the said objects that are present a number of times smaller than the said specified threshold (the said objects being referred to hereinafter as moving objects), whereby detecting the presence of a stationary object situated entirely under the interface and thus tripping an alarm.

9. A system for detecting an object in a zone situated in the proximity of an interface between two liquid media and/or gaseous media; the said object being illuminated by electromagnetic radiation comprising at least two different wavelengths; the said media having different absorption coefficients as a function of the wavelengths of the electromagnetic radiation; the said system comprising:

selecting means for choosing, from among the wavelengths of the electromagnetic radiation, at least two wavelengths or two wavelength regions, filming means for creating, for each of the said wavelengths or wavelength regions, an image of the said interface and of the said zone, converting means for producing electrical signals representative of each image, digitizing means for digitizing the electrical signals in such a way as to produce data corresponding to each image, information-processing means for extracting, from the said data corresponding to each image, two groups of data, wherein the groups are representative of at least part of the said object in the near infrared region and in the blue-green region respectively, and calculating means for comparing the said groups of data;

the converting means, the digitizing means, the information-processing means and the calculating means being referred to hereinafter as the means for deducing the presence of an object, whereby detecting the presence of an object and/or determining the position of the detected object relative to the said interface, while discriminating between an object situated under the interface and an object situated at least partly above the interface.

10. The system according to claim 9, additionally comprising:

integrating means for integrating over time the results of the means for calculating the said groups of data.

11. The system according to claim 10, additionally comprising:

activating means for activating an alarm if an object of human size is detected under the said interface for a time longer than a specified threshold.

12. The system according to claim 11, wherein the said information-processing means make it possible to generate calottes.

13. The system according to claim 12, wherein the said information-processing means make it possible:

to associate characteristics with each calotte, and to deduce the presence of a group of data, wherein the group is representative of at least part of the said object, if the characteristics exceed a predetermined threshold.

14. The system according to claim 11, wherein the said calculating means make it possible to search for data representative of at least part of the said object in the blue-green region, for which data, within a specified geometric vicinity, there are no corresponding data representative of at least part of the said object in the near infrared region;

whereby concluding from a positive search that the said object is situated under the interface.

15. The system according to claim 9, wherein the said calculating means make it possible to search for data representative of at least part of the said object in the blue-green region, for which data, within a specified geometric vicinity, there are corresponding data representative of at least part of the said object in the near infrared region;

whereby concluding from a positive search that the said object is situated at least partly above the interface.

16. The system according to claim 10, more particularly intended to discriminate between a stationary object and a moving object the said integrating means for integrating over time the results of the calculating means making it possible:

to iterate, at specified time intervals, the use of the said means for deducing the presence of the said object;

to calculate the number of times that the said object is detected during a specified time period; and to discriminate, at one point of the said zone, between the said objects that are present a number of times greater than a specified threshold (the said objects being referred to hereinafter as stationary objects) and the said objects that are present a number of times smaller than the said specified threshold (the said objects being referred to hereinafter as moving objects);

whereby concluding the presence of a stationary object situated entirely under the interface;

whereby tripping an alarm.

17. The method according to claim 1, wherein the interface is an interface of the water/air type.

18. The method according to claim 1, wherein the two different wavelengths are situated in regions corresponding to near infrared or blue-green.

19. The system according to claim 9, wherein the interface is an interface of the water/air type.

20. The system according to claim 9, wherein the two different wavelengths are situated in regions corresponding to near infrared or blue-green.

* * * * *